US008992286B2

(12) United States Patent
Cherian et al.

(10) Patent No.: US 8,992,286 B2
(45) Date of Patent: Mar. 31, 2015

(54) WEIGHTED REGRESSION OF THICKNESS MAPS FROM SPECTRAL DATA

(71) Applicant: Applied Materials, Inc., Santa Clara, CA (US)

(72) Inventors: Benjamin Cherian, San Jose, CA (US); Jeffrey Drue David, San Jose, CA (US); Boguslaw A. Swedek, Cupertino, CA (US); Dominic J. Benvegnu, La Honda, CA (US); Jun Qian, Sunnyvale, CA (US); Thomas H. Osterheld, Mountain View, CA (US)

(73) Assignee: Applied Materials, Inc., Santa Clara, CA (US)

( * ) Notice: Subject to any disclaimer, the term of this patent is extended or adjusted under 35 U.S.C. 154(b) by 180 days.

(21) Appl. No.: 13/777,672

(22) Filed: Feb. 26, 2013

(65) Prior Publication Data

US 2014/0242878 A1 Aug. 28, 2014

(51) Int. Cl.

| | |
|---|---|
| ***B24B 1/00*** | (2006.01) |
| ***B24B 49/12*** | (2006.01) |
| ***B24B 37/013*** | (2012.01) |

(52) U.S. Cl.

CPC ..... *B24B 49/12* (2013.01); *B24B 37/013* (2013.01)

USPC ..... 451/5; 451/6; 451/57; 451/58; 451/285; 451/287; 700/173

(58) Field of Classification Search

CPC ..... B24B 37/013; B24B 49/12; B24B 1/00; B24B 49/00

USPC ..... 451/5, 6, 41, 57–58, 285–290

See application file for complete search history.

(56) References Cited

U.S. PATENT DOCUMENTS

| | | | | |
|---|---|---|---|---|
| 7,195,535 | B1 | 3/2007 | Swedek et al. | |
| 7,722,436 | B2 * | 5/2010 | Guthrie et al. | 451/5 |

(Continued)

FOREIGN PATENT DOCUMENTS

| | | |
|---|---|---|
| KR | 10-2012-0010180 | 2/2012 |
| KR | 10-2013-0018604 | 2/2013 |

OTHER PUBLICATIONS

International Search Report and Written Opinion in International Application No. PCT/US2014/018409, mailed May 30, 2014, 10 pages.

(Continued)

*Primary Examiner* — George Nguyen

(74) *Attorney, Agent, or Firm* — Fish & Richardson P.C.

(57) ABSTRACT

A method of controlling a polishing operation includes measuring a plurality of spectra at a plurality of different positions on a substrate to provide a plurality of measured spectra. For each measured spectrum of the plurality of measured spectra, a characterizing value is generated based on the measured spectrum. For each characterizing value, a goodness of fit of the measured spectrum to another spectrum used in generating the characterizing value is determined. A wafer-level characterizing value map is generated by applying a regression to the plurality of characterizing values with the plurality of goodnesses of fit used as weighting factors in the regression. A polishing endpoint or a polishing parameter of the polishing apparatus is adjusted based on the wafer-level characterizing map, and the substrate or a subsequent substrate is polished in the polishing apparatus with the adjusted polishing endpoint or polishing parameter.

20 Claims, 4 Drawing Sheets

(56) References Cited

U.S. PATENT DOCUMENTS

| | | | | |
|---|---|---|---|---|
| 7,988,529 | B2 * | 8/2011 | Chandrasekaran et al. | 451/6 |
| 8,360,817 | B2 * | 1/2013 | Ishii et al. | 451/5 |
| 8,563,335 | B1 | 10/2013 | Benvegnu et al. | |
| 8,808,059 | B1 * | 8/2014 | David | 451/5 |
| 2001/0053588 | A1 | 12/2001 | Neily et al. | |
| 2003/0190864 | A1 * | 10/2003 | Lehman et al. | 451/5 |
| 2005/0153631 | A1 * | 7/2005 | Obeng | 451/5 |
| 2007/0155284 | A1 * | 7/2007 | Ring et al. | 451/5 |
| 2008/0051009 | A1 * | 2/2008 | Wang et al. | 451/8 |
| 2009/0111358 | A1 * | 4/2009 | Nakao et al. | 451/5 |
| 2009/0235224 | A1 | 9/2009 | Kim | |
| 2010/0056023 | A1 | 3/2010 | David et al. | |
| 2010/0114354 | A1 * | 5/2010 | Lee | 700/103 |
| 2010/0217430 | A1 | 8/2010 | David et al. | |
| 2011/0256805 | A1 | 10/2011 | David et al. | |
| 2012/0026492 | A1 | 2/2012 | Zhang et al. | |

OTHER PUBLICATIONS

U.S. Appl. No. 61/608,284, filed Mar. 8, 2012, David et al.

U.S. Appl. No. 13/454,002, filed Apr. 23, 2012, Benvegnu et al.

Stine et al., "Analysis and Decomposition of Spatial Variation in Integrated Circuit Processes and Devices," *IEEE Transactions on Semiconductor Manufacturing*, Feb. 1997, 10(1):24-41.

Leon and Adomaitis, "Full wafer mapping and response surface modeling techniques for thin film deposition processes," *The Institute for Systems Research, ISR Technical Report*, Dec. 2008, 18 pages.

* cited by examiner

WEIGHTED REGRESSION OF THICKNESS MAPS FROM SPECTRAL DATA

TECHNICAL FIELD

The present disclosure relates to polishing control methods, e.g., for chemical mechanical polishing of substrates.

BACKGROUND

An integrated circuit is typically formed on a substrate by the sequential deposition of conductive, semiconductive, or insulative layers on a silicon wafer. A variety of fabrication processes require planarization of a layer on the substrate. For example, for certain applications, e.g., polishing of a metal layer to form vias, plugs, and lines in the trenches of a patterned layer, an overlying layer is planarized until the top surface of a patterned layer is exposed. In other applications, e.g., planarization of a dielectric layer for photolithography, an overlying layer is polished until a desired thickness remains over the underlying layer.

Chemical mechanical polishing (CMP) is one accepted method of planarization. This planarization method typically requires that the substrate be mounted on a carrier head. The exposed surface of the substrate is typically placed against a rotating polishing pad. The carrier head provides a controllable load on the substrate to push it against the polishing pad. A polishing liquid, such as slurry with abrasive particles, is typically supplied to the surface of the polishing pad.

One problem in CMP is determining whether the polishing process is complete, i.e., whether a substrate layer has been planarized to a desired flatness or thickness, or when a desired amount of material has been removed. Variations in the initial thickness of the substrate layer, the slurry composition, the polishing pad condition, the relative speed between the polishing pad and the substrate, and the load on the substrate can cause variations in the material removal rate. These variations cause variations in the time needed to reach the polishing endpoint. Therefore, it may not be possible to determine the polishing endpoint merely as a function of polishing time.

In some systems, a substrate is optically measured in a stand-alone metrology station. However, such systems often have limited throughput. In some systems, a substrate is optically monitored in-situ during polishing, e.g., through a window in the polishing pad. However, existing optical monitoring techniques may not satisfy increasing demands of semiconductor device manufacturers.

SUMMARY

A thickness map, i.e., a one-dimensional or two-dimensional map of the thickness of a layer of the substrate, can be useful for controlling polishing operations. For example, a thickness map can be fed to a process control module that will determine how to adjust polishing parameters in order to improve within-wafer or wafer-to wafer uniformity.

A wafer-level thickness map is generally intended to indicate the wafer-scale variations in thickness across the wafer; in effect the die-scale variations are filtered or smoothed out. A thickness map can be "parametric", e.g., the thickness can be stored as a parameterized function of position, or "non-parametric", e.g., stored as thickness values with associated positions.

When a thickness map is generated by an in-sequence (or in-situ) monitoring system, spectral measurements typically need to be taken with a large spot size and with high relative motion between the probe and the substrate, at least in comparison to a stand-alone metrology station. As a result, the thickness calculated from the individual spectra can be relatively imprecise.

Another approach is that during the regression to generate the thickness map, each thickness value is weighted according to the goodness of fit of the model or the reference spectrum to the measured spectra. This can improve the reliability of the wafer-level thickness map.

In one aspect, a method of controlling a polishing operation includes measuring a plurality of spectra reflected from a substrate at a plurality of different positions on the substrate with an in-sequence or in-situ monitoring system to provide a plurality of measured spectra, for each measured spectrum of the plurality of measured spectra, generating a characterizing value based on the measured spectrum, for each characterizing value, determining a goodness of fit of the measured spectrum to another spectrum used in generating the characterizing value to provide a plurality of goodnesses of fit, generating a wafer-level characterizing value map by applying a regression to the plurality of characterizing values with the plurality of goodnesses of fit used as weighting factors in the regression, adjusting a polishing endpoint or a polishing parameter of the polishing apparatus based on the wafer-level characterizing map, and polishing the substrate or a subsequent substrate in the polishing apparatus with the adjusted polishing endpoint or polishing parameter.

Implementations may include one or more of the following features. The characterizing value may be a thickness of an outermost layer on the substrate. Generating the characterizing value may include fitting an optical model to the measured spectrum. The fitting may include finding a value of an input parameter to the optical model that provides a minimum difference between an output spectrum of the optical model and the measured spectrum. The goodness of fit may be a goodness of fit between the measured spectrum and the output spectrum of the optical model for the value of the input parameter. The goodness of fit may be a sum of absolute differences, a sum of squared differences, or a cross-correlation between the measured spectrum and the output spectrum. Generating the characterizing value may include storing a plurality of reference spectra, determining a best matching reference spectrum from the plurality of reference spectra that provides a best match to the measured spectrum, and determining the characterizing value associated with the best matching reference spectrum. The goodness of fit may be a goodness of fit between the measured spectrum and the best matching reference spectrum. The goodness of fit may be a sum of absolute differences, a sum of squared differences, or a cross-correlation between the measured spectrum and the best matching reference spectrum. Measuring the spectrum may be performed with the in-line monitoring system before polishing of the substrate. The regression may be a parametric regression. The parametric regression may fit an angularly symmetric function to the plurality of characterizing values. The regression may be a non-parametric regression. The non-parametric regression may be spline smoothing or wavelet thresholding.

In another aspect, a non-transitory computer program product, tangibly embodied in a machine readable storage device, includes instructions to carry out the method.

Certain implementations may include one or more of the following advantages. A thickness map may be more accurate. The thickness map can be generated with a sufficiently high density of measurements to allow extraction of within die variation. Within-wafer and wafer-to-wafer thickness non-uniformity (WIWNU and WTWNU) may be reduced, and reliability of the endpoint system to detect a desired polishing endpoint may be improved.

BRIEF DESCRIPTION OF THE DRAWINGS

Like reference numbers and designations in the various drawings indicate like elements.

DETAILED DESCRIPTION

One optical monitoring technique for controlling a polishing operation is to measure a spectrum of light reflected from a substrate, either in-situ during polishing or at an in-line metrology station, and fit a function, e.g., an optical model, to the measured spectra. Another technique is to compare the measured spectrum to a plurality of reference spectra from a library, and identify a best-matching reference spectrum.

Either fitting of the optical model or identification of the best matching reference spectrum are used to generate a characterizing value, e.g., the thickness of the outermost layer. For the fitting, the thickness can be treated as an input parameter of the optical model, and the fitting process generates a value for the thickness. For finding a match, the thickness value associated with the reference spectrum can be identified.

Chemical mechanical polishing can be used to planarize the substrate until a predetermined thickness of the first layer is removed, a predetermined thickness of the first layer remains, or until the second layer is exposed.

Figure 1:
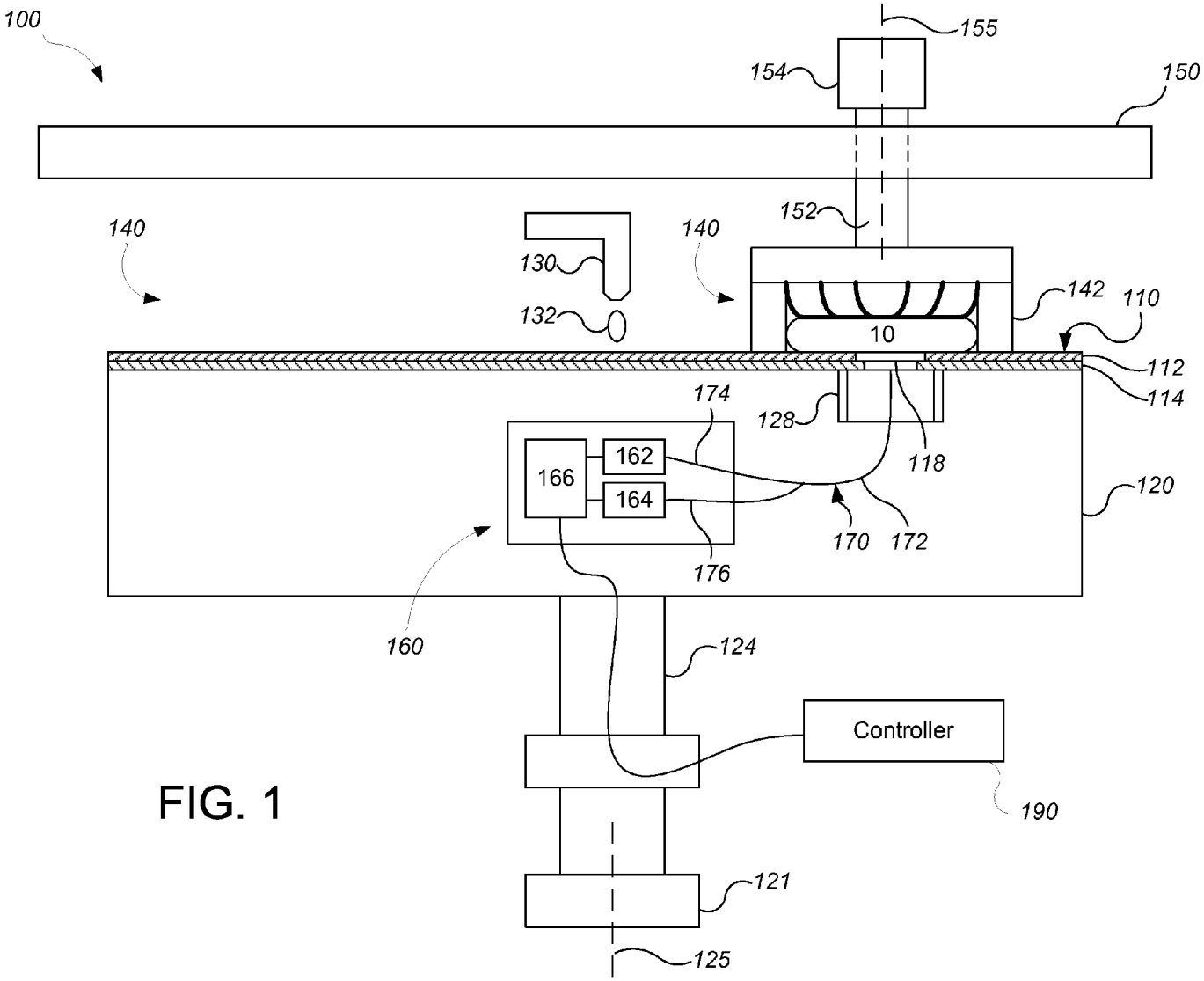
FIG. 1 illustrates a schematic cross-sectional view of an example of a polishing station.

FIG. 1 illustrates an example of a polishing apparatus 100. The polishing apparatus 100 includes a rotatable disk-shaped platen 120 on which a polishing pad 110 is situated. The platen is operable to rotate about an axis 125. For example, a motor 121 can turn a drive shaft 124 to rotate the platen 120. The polishing pad 110 can be a two-layer polishing pad with an outer polishing layer 112 and a softer backing layer 114.

The polishing apparatus 100 can include a port 130 to dispense polishing liquid 132, such as a slurry, onto the polishing pad 110 to the pad. The polishing apparatus can also include a polishing pad conditioner to abrade the polishing pad 110 to maintain the polishing pad 110 in a consistent abrasive state.

The polishing apparatus 100 includes one or more carrier heads 140. Each carrier head 140 is operable to hold a substrate 10 against the polishing pad 110. Each carrier head 140 can have independent control of the polishing parameters, for example pressure, associated with each respective substrate. Each carrier head includes a retaining ring 142 to hold the substrate 10 in position on the polishing pad 110.

Each carrier head 140 is suspended from a support structure 150, e.g., a carousel or a track, and is connected by a drive shaft 152 to a carrier head rotation motor 154 so that the carrier head can rotate about an axis 155. Optionally each carrier head 140 can oscillate laterally, e.g., on sliders on the carousel 150; by rotational oscillation of the carousel itself, or by motion of a carriage 108 that supports the carrier head 140 along the track.

In operation, the platen is rotated about its central axis 125, and each carrier head is rotated about its central axis 155 and translated laterally across the top surface of the polishing pad.

While only one carrier head 140 is shown, more carrier heads can be provided to hold additional substrates so that the surface area of polishing pad 110 may be used efficiently. Thus, the number of carrier head assemblies adapted to hold substrates for a simultaneous polishing process can be based, at least in part, on the surface area of the polishing pad 110.

In some implementations, the polishing apparatus includes an in-situ optical monitoring system 160, e.g., a spectrographic monitoring system, which can be used to measure a spectrum of reflected light from a substrate undergoing polishing. An optical access through the polishing pad is provided by including an aperture (i.e., a hole that runs through the pad) or a solid window 118.

Figure 2:
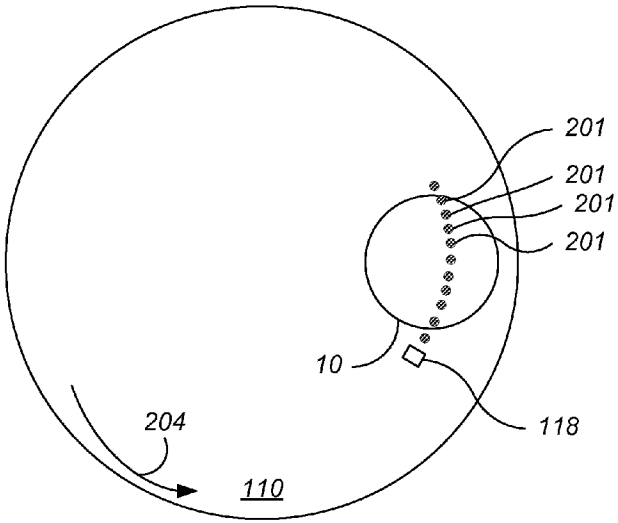
FIG. 2 illustrates a top view of a polishing pad and shows locations where in-situ measurements are taken on a substrate.

Referring to FIG. 2, if the window 118 is installed in the platen, due to the rotation of the platen (shown by arrow 204), as the window 108 travels below a carrier head, the optical monitoring system making spectra measurements at a sampling frequency will cause the spectra measurements to be taken at locations 201 in an arc that traverses the substrate 10.

Figure 3:
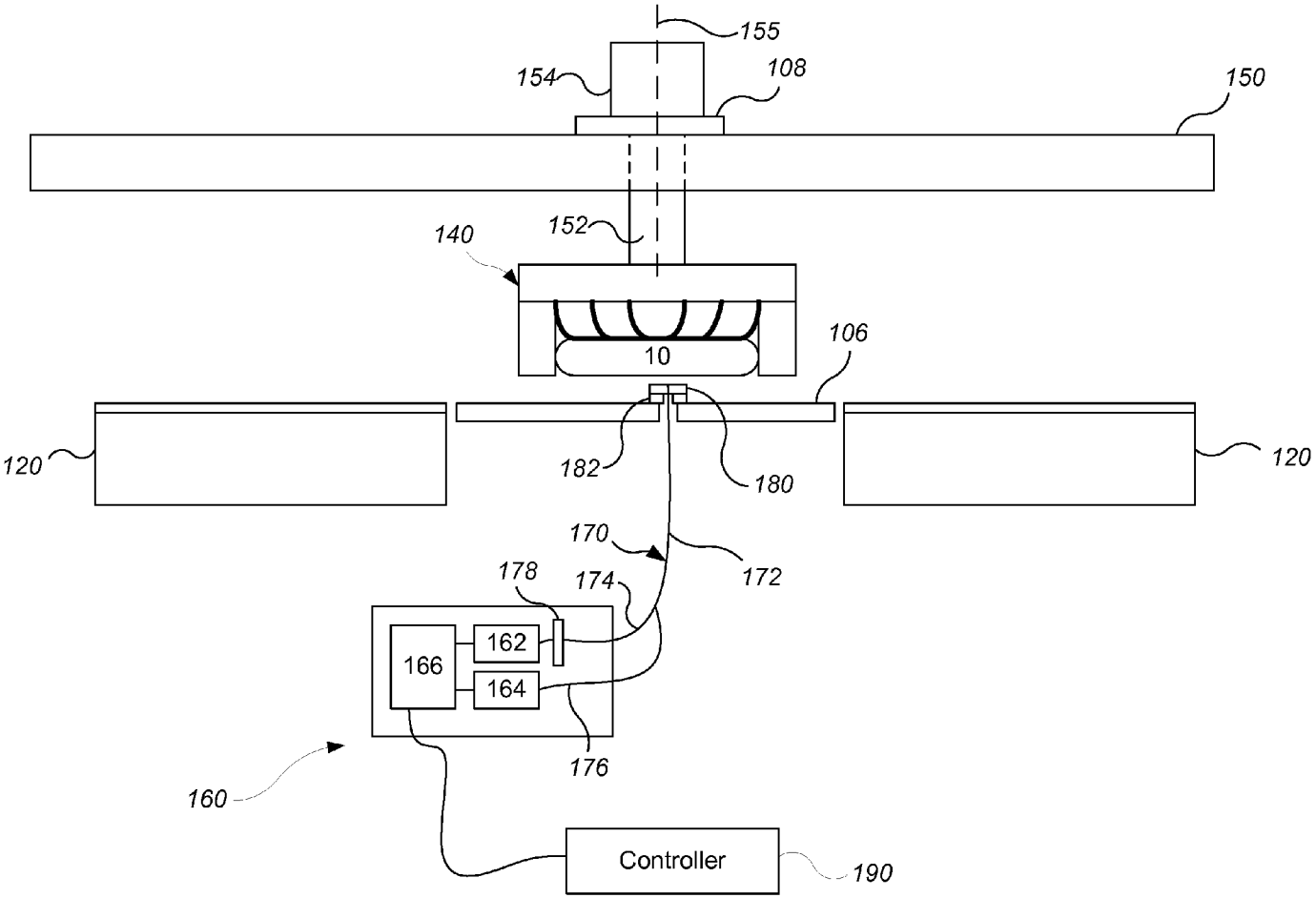
FIG. 3 illustrates a schematic cross-sectional view of an example of an in-line monitoring station.

In some implementation, illustrated in FIG. 3, the polishing apparatus includes an in-sequence optical monitoring system 160 having a probe 180 positioned between two polishing stations or between a polishing station and a transfer station. The probe 180 of the in-sequence monitoring system 160 can be supported on a platform 106, and can be positioned on the path of the carrier head.

The probe 180 can include a mechanism to adjust its vertical height relative to the top surface of the platform 106. In some implementations, the probe 180 is supported on an actuator system 182 that is configured to move the probe 180 laterally in a plane parallel to the plane of the track 128. The actuator system 182 can be an XY actuator system that includes two independent linear actuators to move probe 180 independently along two orthogonal axes. In some implementations, there is no actuator system 182, and the probe 180 remains stationary (relative to the platform 106) while the carrier head 126 moves to cause the spot measured by the probe 180 to traverse a path on the substrate.

Figure 4:
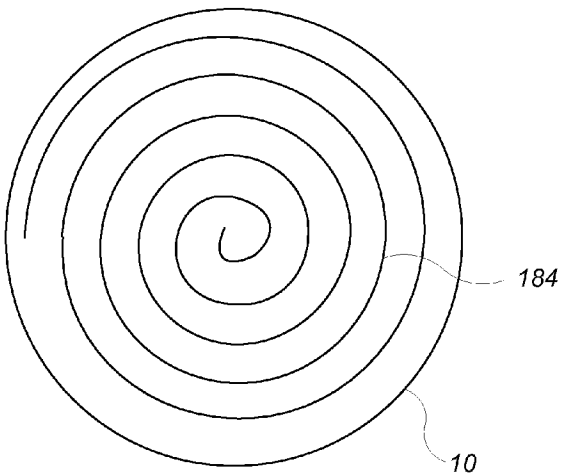
FIG. 4 illustrates a path of a probe over a substrate.

Referring to FIG. 4, the probe 180 can traverse a path 184 over the substrate while the monitoring system take a sequence of spectra measurements, so that a plurality of spectra are measured at different positions on the substrate. By proper selection of the path and the rate of spectra measurement, the measurements can be made at a substantially uniform density over the wafer. Alternatively, more measurements can be made near the edge of the substrate.

In the specific implementation shown in FIG. 4, the carrier head 126 can rotate while the carriage 108 causes the center of the substrate to move outwardly from the probe 180, which causes the spot 184 measured by the probe 180 to traverse a spiral path 184 on the substrate 10. However, other combinations of motion can cause the probe to traverse other paths, e.g., a series of concentric circles or a series of arcuate segments passing through the center of the substrate 10. Moreover, if the monitoring station includes an XY actuator system, the measurement spot 184 can traverse a path with a plurality of evenly spaced parallel line segments. This permits the optical metrology system 160 to take measurements that are spaced in a rectangular pattern over the substrate.

Returning to FIGS. 1 and 3, in either the in-situ or in-sequence embodiments, the optical monitoring system 160 can include a light source 162, a light detector 164, and circuitry 166 for sending and receiving signals between a remote controller 190, e.g., a computer, and the light source 162 and light detector 164. One or more optical fibers can be used to transmit the light from the light source 162 to the optical access in the polishing pad, and to transmit light reflected from the substrate 10 to the detector 164. For example, a bifurcated optical fiber 170 can be used to transmit the light from the light source 162 to the substrate 10 and back to the detector 164. The bifurcated optical fiber an include a trunk 172 positioned in proximity to the optical access, and two branches 174 and 176 connected to the light source 162 and detector 164, respectively. The probe 180 can include the trunk end of the bifurcated optical fiber.

The light source 162 can be operable to emit white light. In one implementation, the white light emitted includes light having wavelengths of 200-800 nanometers. In some implementations, the light source 162 generates unpolarized light. In some implementations, a polarization filter 178 (illustrated in FIG. 3, although it can be used in the in-situ system of FIG. 1) can be positioned between the light source 162 and the substrate 10. A suitable light source is a xenon lamp or a xenon mercury lamp.

Figure 5:
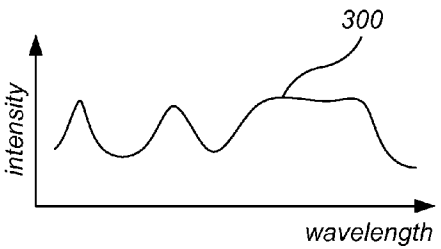
FIG. 5 illustrates a measured spectrum from the optical monitoring system.

The light detector 164 can be a spectrometer. A spectrometer is an optical instrument for measuring intensity of light over a portion of the electromagnetic spectrum. A suitable spectrometer is a grating spectrometer. Typical output for a spectrometer is the intensity of the light as a function of wavelength (or frequency). FIG. 5 illustrates an example of a measured spectrum 300.

As noted above, the light source 162 and light detector 164 can be connected to a computing device, e.g., the controller 190, operable to control their operation and receive their signals. The computing device can include a microprocessor situated near the polishing apparatus, e.g., a programmable computer. In operation, the controller 190 can receive, for example, a signal that carries information describing a spectrum of the light received by the light detector for a particular flash of the light source or time frame of the detector.

For each measured spectrum, the controller 190 can calculate a characterizing value. The characterizing value is typically the thickness of the outer layer, but can be a related characteristic such as thickness removed. In addition, the characterizing value can be a physical property other than thickness, e.g., metal line resistance. In addition, the characterizing value can be a more generic representation of the progress of the substrate through the polishing process, e.g., an index value representing the time or number of platen rotations at which the spectrum would be expected to be observed in a polishing process that follows a predetermined progress.

One technique to calculate a characterizing value is, for each measured spectrum, to identify a matching reference spectrum from a library of reference spectra. Each reference spectrum in the library can have an associated characterizing value, e.g., a thickness value or an index value indicating the time or number of platen rotations at which the reference spectrum is expected to occur. By determining the associated characterizing value for the matching reference spectrum, a characterizing value can be generated. This technique is described in U.S. Patent Publication No. 2010-0217430, which is incorporated by reference.

Another technique is to fit an optical model to the measured spectrum. In particular, a parameter of the optical model is optimized to provide the best fit of the model to the measured spectrum. The parameter value generated for the measured spectrum generates the characterizing value. This technique is described in U.S. Patent Application No. 61/608,284, filed Mar. 8, 2012, which is incorporated by reference. Possible input parameters of the optical model can include the thickness, index of refraction and/or extinction coefficient of each of the layers, spacing and/or width of a repeating feature on the substrate.

Calculation of a difference between the output spectrum and the measured spectrum can be a sum of absolute differences between the measured spectrum and the output spectrum across the spectra, or a sum of squared differences between the measured spectrum and the reference spectrum. Other techniques for calculating the difference are possible, e.g., a cross-correlation between the measured spectrum and the output spectrum can be calculated.

Fitting the parameters to find the closest output spectrum can be considered an example of finding a global minima of a function (the difference between the measured spectrum and the output spectrum generated by the function) in a multidimensional parameter space (with the parameters being the variable values in the function). For example, where the function is an optical model, the parameters can include the thickness, the index of refraction (n) and extinction coefficient (k) of the layers.

Regression techniques can be used to optimize the parameters to find a local minimum in the function. Examples of regression techniques include Levenberg-Marquardt (L-M)—which utilizes a combination of Gradient Descent and Gauss-Newton; Fminunc( )—a matlab function; lsqnonlin( )—matlab function that uses the L-M algorithm; and simulated annealing. In addition, non-regression techniques, such as the simplex method, can be used to optimize the parameters.

Another technique is to analyze a characteristic of a spectral feature from the measured spectrum, e.g., a wavelength or width of a peak or valley in the measured spectrum. The wavelength or width value of the feature from the measured spectrum provides the characterizing value. This technique is described in U.S. Patent Publication No. 2011-0256805, which is incorporated by reference.

Another technique is to perform a Fourier transform of the measured spectrum. A position of one of the peaks from the transformed spectrum is measured. The position value generated for measured spectrum generates the characterizing value. This technique is described in U.S. patent application Ser. No. 13/454,002, filed Apr. 23, 2012, which is incorporated by reference.

Each of the above techniques could be applied for spectra obtained in either in-situ or in-line monitoring.

Figure 6:
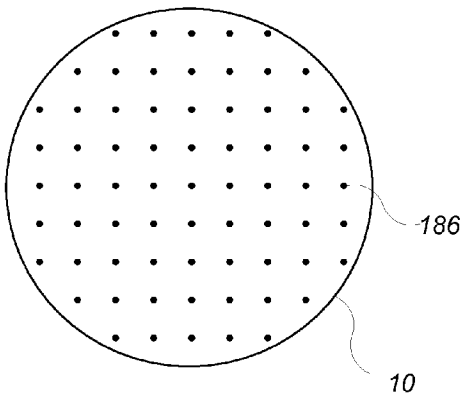
FIG. 6 illustrates locations on a substrate at which spectra are measured.

Since the plurality of spectra are measured at different positions on the substrate, the characterizing values correspond to different locations on the substrate. For example, FIG. 6 illustrates positions 186 of the characterizing values across the substrate 10. Although FIG. 6 illustrates a rectangular array of positions, other patterns are possible, e.g., spiral or circular. The density of measurements can be selected by the user depending on throughput constraints. The density of measurements can be between about 0.1 to 1 per square millimeter. In some implementations, each characterizing value is stored with its associated position on the substrate. The collection of characterizing values can be considered a map of the substrate, e.g., a thickness map if the characterizing value is the layer thickness.

Due to the presence of die-level variations, e.g., regions of differing line density and the like, the map of the substrate includes a combination of both wafer-level variations and die-level variations. It is desirable to extract the wafer-level variations and use this information to improve within-wafer and wafer-to-wafer uniformity. Therefore the data in the preliminary map can be subjected to parametric or non-parametric regression in order to remove the die-level variation. In one sense, the die-level variations can be considered noise that is removed by a filtering process, e.g., the regression algorithm, leaving the wafer-level variations.

An example of a parametric regression is to fit a function, e.g., a function with angular periodicity, e.g., an angularly symmetric function, to the characterizing values. Examples of a non-parametric regression include spline smoothing and wavelet thresholding.

However, some of the variations can be imprecision in the spectral measurements, e.g., due to the large spot size and high relative motion between the probe and the substrate. Therefore, rather than simply perform a regression that weights the characterizing values equally, e.g., as if "noise" was due to die-level variations, during the regression to generate the wafer-level map, each value is weighted according to the goodness of fit of the model or the reference spectrum to the measured spectra. This can improve the reliability of the wafer-level map.

Each of the implementations described above for finding a characterizing value can have an associated goodness of fit. For example, in the implementation in which a best-matching spectrum of a plurality of reference spectra is identified, the goodness of fit can be a difference value between the measured spectrum and the best-matching reference spectrum. Similarly, in the implementation in which an optical model is fit to the measured spectrum, the goodness of fit can be a difference value between the measured spectrum and the output spectrum of the optical model at the optimized parameters.

In either case, the difference value can be calculated a sum of absolute differences between the measured spectrum and the reference spectrum, a sum of squared differences between the measured spectrum and the reference spectrum, or a cross-correlation between the measured spectrum and the reference spectrum. The same goodness of fit algorithm that is used in identifying the best matching reference spectrum out of the plurality of reference spectra can be used to determine the goodness of fit of the best-matching reference spectrum to the measured spectrum, although this is not required.

The general procedure for performing a regression that weights the values according to the goodness of fit is described below. Suppose a spectrum reflected from a substrate is measured, e.g., with an in-sequence metrology system. Each spectrum collected at coordinates ($x_i$; $y_i$) is converted to a characterizing value, e.g., thickness, $z_i$ via some optical model where the match between the spectrum and the model is characterized by some goodness of fit $w_i$, where $w_i$ is non-negative and monotonically increases as the fit between the model and measured spectrum improves.

The noise in these characterizing values can be reduced by the use of parametric regression. In the case of linear regression (a form of parametric regression), the following treatment applies. In a typical multiple regression model, the data is treated as being of the form below:

$$z=M^T+\beta+\epsilon$$

In the above equation $z=(z_i, \ldots z_n)$, a vector containing the characterizing values, e.g., thicknesses, extracted from the spectra. M is a matrix with dimensions n×p, where each element of row i is some fixed function $f(x_i,y_i)$ of $x_i$ and $y_i$, and no element is a linear combination of other elements in the row. β is a vector of p regression coefficients which relate the known positions parameters to the film characterizing values $z_i$. ϵ is a vector of length n with each element being the error in extracted thickness for each measurement.

In ordinary linear regression, the estimator of β is given by:

$$\hat{\beta} = \frac{X^T z}{(X^T X)}$$

The film thickness map would thus be given at any point (x,y) by the inner product of $\hat{\beta}$ and a vector consisting of the same functions of x and y that were used for the original data points.

However, one example of an appropriately weighted parametric regression would estimate β with the following expression:

$$\hat{\beta} = \frac{X^T W z}{(X^T W X)}$$

Here W is a diagonal matrix whose non-zero elements are the goodnesses of fit, $w_i$.

In many non-parametric regression techniques based on spline smoothing the following quantity is minimized:

$$\sum_{i=1}^{n} \left(z_i - \hat{f}(x_i, y_i)\right)^2 + \lambda \int P\hat{f}(x, y)\,dx\,dy$$

where $x_i$ and $y_i$ are the vector of the coordinates of measurement I, $\hat{f}$ is the estimated characteristic value map, e.g., thickness value map, P is an operator acting on $\hat{f}$ whose result is a function which characterizes the smoothness of $\hat{f}$ such that $P\hat{f}(x,y)$ is non-negative and increases as the roughness of $\hat{f}$ increases, and λ is a smoothing parameter.

In contrast, one example of using the goodnesses of fit of the modeled thickness is by weighting the terms in the sum as follows:

$$\sum_{i=1}^{n} \frac{nw_i}{\Sigma w_i}\left(z_i - \hat{f}(x_i, y_i)\right)^2 + \lambda \int P\hat{f}(x, y)\,dx\,dy$$

This is merely one example equation, and others can be derived.

The weighted characterizing map, e.g., a weighted thickness map, can be useful for controlling polishing operations. For example, the weighted thickness map can be fed to a process control module that will determine how to adjust polishing parameters in order to improve within-wafer or wafer-to wafer uniformity.

Figure 7:
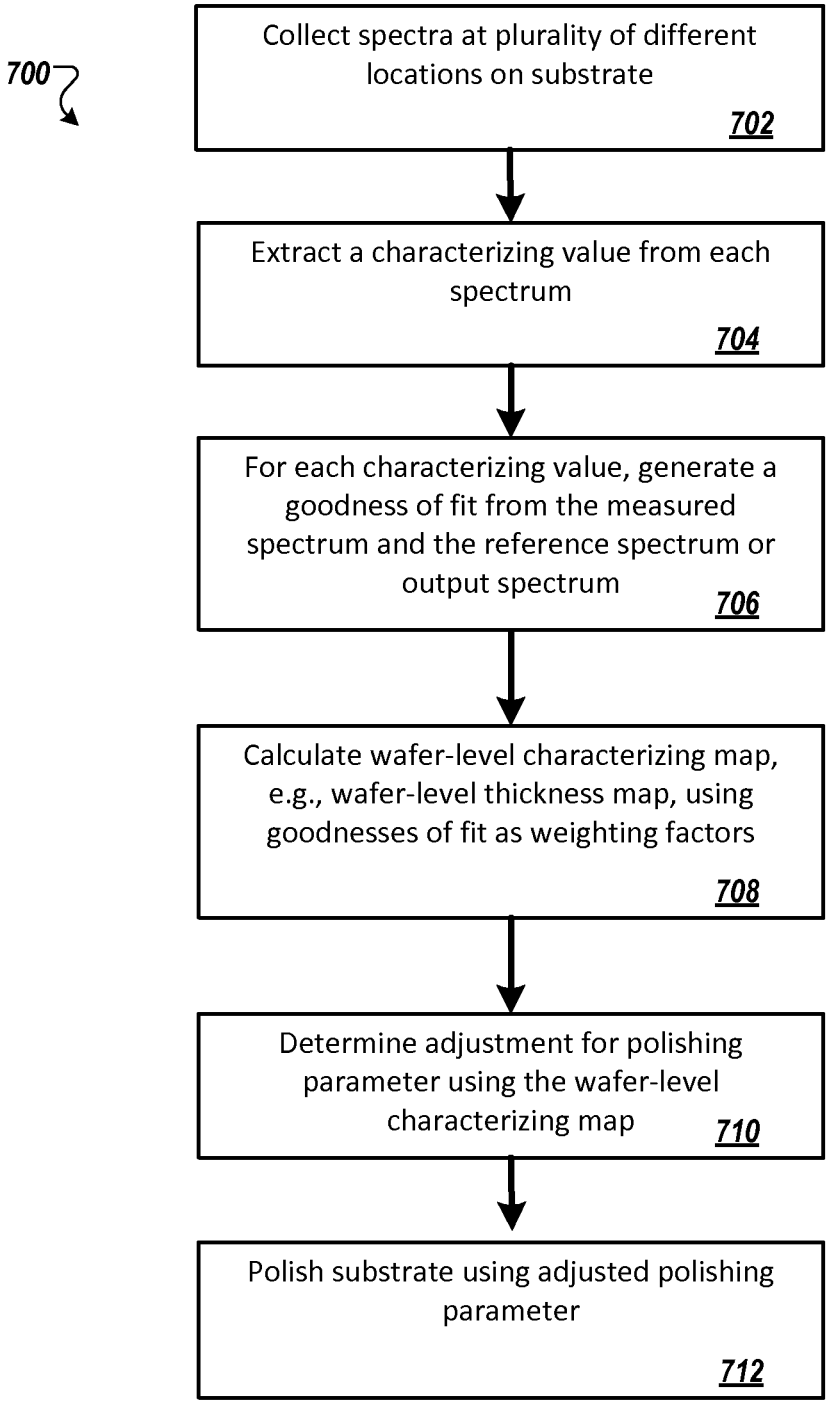
FIG. 7 is a flow diagram of an example process for controlling a polishing operation.

FIG. 7 shows a flow chart of a method 700 of controlling polishing of a product substrate. The product substrate can have at least the same layer structure as what is represented in the optical model.

A plurality of spectra reflected from the product substrate are measured at a plurality of different positions (step 702). The spectra could be measured using an in-sequence optical monitoring system or an in-situ optical monitoring system. A characterizing value, e.g., a thickness, can be extracted from each measured spectrum to provide a plurality of characterizing values, e.g., a plurality of thicknesses (step 704). The characterizing value could be generated by identifying a matching reference spectrum from a library of reference spectra, or by fitting an optical model to the measured spectrum.

For each characterizing value, a goodness of fit is generated and associated with its respective characterizing value (step 706). The goodness of fit is based on the difference between the measured spectrum and the best-fitting reference spectrum or output spectrum generated by the optical model. For example, the goodness of fit can be a sum of absolute differences, a sum of squared differences, or a cross-correlation between the measured spectrum and the best-matching reference spectrum or output spectrum from the optical model.

A wafer-level characterizing value map is generated based on a parametric or non-parametric weighted regression that uses the goodnesses of fit as weighting factors (step 708).

The wafer-level characterizing value is then fed to process control module that determines how to adjust polishing parameters in order to improve within-wafer or wafer-to wafer uniformity (step 710). Ultimately, a substrate is polished using the adjusted polishing parameters (set 712).

As used in the instant specification, the term substrate can include, for example, a product substrate (e.g., which includes multiple memory or processor dies), a test substrate, a bare substrate, and a gating substrate. The substrate can be at various stages of integrated circuit fabrication, e.g., the substrate can be a bare wafer, or it can include one or more deposited and/or patterned layers. The term substrate can include circular disks and rectangular sheets.

Embodiments of the invention and all of the functional operations described in this specification can be implemented in digital electronic circuitry, or in computer software, firmware, or hardware, including the structural means disclosed in this specification and structural equivalents thereof, or in combinations of them. Embodiments of the invention can be implemented as one or more computer program products, i.e., one or more computer programs tangibly embodied in a non-transitory machine readable storage media, for execution by, or to control the operation of, data processing apparatus, e.g., a programmable processor, a computer, or multiple processors or computers.

The above described polishing apparatus and methods can be applied in a variety of polishing systems. Either the polishing pad, or the carrier heads, or both can move to provide relative motion between the polishing surface and the substrate. For example, the platen may orbit rather than rotate. The polishing pad can be a circular (or some other shape) pad secured to the platen. Some aspects of the endpoint detection system may be applicable to linear polishing systems, e.g., where the polishing pad is a continuous or a reel-to-reel belt that moves linearly. The polishing layer can be a standard (for example, polyurethane with or without fillers) polishing material, a soft material, or a fixed-abrasive material. Terms of relative positioning are used; it should be understood that the polishing surface and substrate can be held in a vertical orientation or some other orientation.

Although the description above has focused on control of a chemical mechanical polishing system, the in-sequence metrology station can be applicable to other types of substrate processing systems, e.g., etching or deposition systems.

Particular embodiments of the invention have been described. Other embodiments are within the scope of the following claims.

What is claimed is:

1. A method of controlling a polishing operation, comprising:

measuring a plurality of spectra reflected from a substrate at a plurality of different positions on the substrate with an in-sequence or in-situ monitoring system to provide a plurality of measured spectra;

for each measured spectrum of the plurality of measured spectra, generating a characterizing value based on the measured spectrum;

for each characterizing value, determining a goodness of fit of the measured spectrum to another spectrum used in generating the characterizing value to provide a plurality of goodnesses of fit;

generating a wafer-level characterizing value map by applying a regression to the plurality of characterizing values with the plurality of goodnesses of fit used as weighting factors in the regression;

adjusting a polishing endpoint or a polishing parameter of a polishing apparatus based on the wafer-level characterizing map; and polishing the substrate or a subsequent substrate in the polishing apparatus with the adjusted polishing endpoint or polishing parameter.

2. The method of claim 1, wherein the characterizing value is a thickness of an outermost layer on the substrate.

3. The method of claim 1, wherein generating the characterizing value comprises fitting an optical model to the measured spectrum, the fitting including finding a value of an input parameter to the optical model that provides a minimum difference between an output spectrum of the optical model and the measured spectrum.

4. The method of claim 3, wherein the goodness of fit is a goodness of fit between the measured spectrum and the output spectrum of the optical model for the value of the input parameter.

5. The method of claim 4, wherein the goodness of fit is a sum of absolute differences, a sum of squared differences, or a cross-correlation between the measured spectrum and the output spectrum.

6. The method of claim 1, wherein generating the characterizing value comprises storing a plurality of reference spectra, determining a best matching reference spectrum from the plurality of reference spectra that provides a best match to the measured spectrum, and determining the characterizing value associated with the best matching reference spectrum.

7. The method of claim 6, wherein the goodness of fit is a goodness of fit between the measured spectrum and the best matching reference spectrum.

8. The method of claim 7, wherein the goodness of fit is a sum of absolute differences, a sum of squared differences, or a cross-correlation between the measured spectrum and the best matching reference spectrum.

9. The method of claim 1, wherein measuring the plurality of spectra is performed with the in-sequence monitoring system before polishing of the substrate.

10. The method of claim 1, wherein the regression is a parametric regression.

11. The method of claim 10, wherein the parametric regression fits an angularly symmetric function to the plurality of characterizing values.

12. The method of claim 1, wherein the regression is a non-parametric regression.

13. The method of claim 12, wherein the non-parametric regression is spline smoothing or wavelet thresholding.

14. A computer program product, tangibly embodied in a non-transitory machine readable storage media, comprising instructions to cause a processor to:

receive a plurality of measured spectra from an in-sequence or in-situ monitoring system, the plurality of measured spectra being spectra reflected from a substrate at a plurality of different positions on the substrate;

for each measured spectrum of the plurality of measured spectra, generate a characterizing value based on the measured spectrum;

for each characterizing value, determine a goodness of fit of the measured spectrum to another spectrum used in generating the characterizing value to provide a plurality of goodnesses of fit;

generate a wafer-level characterizing value map by applying a regression to the plurality of characterizing values with the plurality of goodnesses of fit used as weighting factors in the regression;

adjust a polishing endpoint or a polishing parameter of a polishing apparatus based on the wafer-level characterizing map; and cause the polishing apparatus to polish the substrate or a subsequent substrate in the polishing apparatus with the adjusted polishing endpoint or polishing parameter.

15. The computer program product of claim 14, wherein the characterizing value is a thickness of an outermost layer on the substrate.

16. The computer program product of claim 14, wherein the instructions to generate the characterizing value comprise instructions to fit an optical model to the measured spectrum, the instructions to fit including instructions to find a value of an input parameter to the optical model that provides a minimum difference between an output spectrum of the optical model and the measured spectrum.

17. The computer program product of claim 16, wherein the goodness of fit is a goodness of fit between the measured spectrum and the output spectrum of the optical model for the value of the input parameter.

18. The computer program product of claim 14, wherein the instructions to generate the characterizing value comprise instructions to store a plurality of reference spectra, determine a best matching reference spectrum from the plurality of reference spectra that provides a best match to the measured spectrum, and determine the characterizing value associated with the best matching reference spectrum.

19. The computer program product of claim 18, wherein the goodness of fit is a goodness of fit between the measured spectrum and the best matching reference spectrum.

20. A polishing apparatus, comprising:

a platen to support a polishing pad;

a carrier head to hold a substrate in contact with the polishing pad;

an in-sequence or in-situ monitoring system configured to measure a plurality of spectra reflected from the substrate at a plurality of different positions on the substrate to provide a plurality of measured spectra; and a controller configured to receive a plurality of measured spectra from the in-sequence or in-situ monitoring system, for each measured spectrum of the plurality of measured spectra, generate a characterizing value based on the measured spectrum, for each characterizing value, determine a goodness of fit of the measured spectrum to another spectrum used in generating the characterizing value to provide a plurality of goodnesses of fit, generate a wafer-level characterizing value map by applying a regression to the plurality of characterizing values with the plurality of goodnesses of fit used as weighting factors in the regression, adjust a polishing endpoint or a polishing parameter of the polishing apparatus based on the wafer-level characterizing map, and cause the polishing apparatus to polish the substrate or a subsequent substrate in the polishing apparatus with the adjusted polishing endpoint or polishing parameter.

* * * * *